US008988321B2

(12) United States Patent
Lee et al.

(10) Patent No.: US 8,988,321 B2
(45) Date of Patent: Mar. 24, 2015

(54) ORGANIC LIGHT EMITTING DISPLAY DEVICE INCLUDING A PLURALITY OF SCAN DRIVING CIRCUITS FOR DRIVING SCAN SIGNALS CORRESPONDING TO IMAGE SIGNALS AND BLACK IMAGE SIGNALS AND METHOD OF DRIVING THE SAME

(75) Inventors: An-Su Lee, Suwon-si (KR); Myung-Ho Lee, Suwon-si (KR); June-Young Song, Suwon-si (KR); Kyoung-Soo Lee, Suwon-si (KR); Myoung-Seop Song, Suwon-si (KR); Yun-Tae Kim, Suwon-si (KR); Jong-Soo Kim, Suwon-si (KR); Jung-Keun Ahn, Suwon-si (KR); Min-Cheol Kim, Suwon-si (KR); Sang-Kyun Cho, Suwon-si (KR); Hye-Jin Shin, Suwon-si (KR); Hun-Tae Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 460 days.

(21) Appl. No.: 12/611,901

(22) Filed: Nov. 3, 2009

(65) Prior Publication Data

US 2010/0188375 A1 Jul. 29, 2010

(30) Foreign Application Priority Data

Jan. 29, 2009 (KR) ..... 10-2009-0006907

(51) Int. Cl.
*G09G 3/30* (2006.01)
*G09G 3/32* (2006.01)

(52) U.S. Cl.
CPC ..... *G09G 3/3266* (2013.01); *G09G 2310/0208* (2013.01); *G09G 2310/0221* (2013.01); *G09G 2310/062* (2013.01); *G09G 2320/0261* (2013.01)
USPC ..... 345/76; 345/204

(58) Field of Classification Search
USPC ..... 345/103, 98–100, 76, 204
See application file for complete search history.

(56) References Cited

U.S. PATENT DOCUMENTS

2004/0164976 A1 8/2004 Nakamura et al.
2004/0189583 A1 9/2004 Park et al.

(Continued)

FOREIGN PATENT DOCUMENTS

CN 1534583 A 10/2004
CN 1650226 A 8/2005

(Continued)

OTHER PUBLICATIONS

Korean Patent Abstracts for Korean Publication 10-2004-0085297, dated Oct. 10, 2004 corresponding to Korean Patent 10-0705617.

(Continued)

*Primary Examiner* — Long D Pham
(74) *Attorney, Agent, or Firm* — Christie, Parker & Hale, LLP

(57) ABSTRACT

A light emitting display is configured to reduce or prevent motion blur by shortening a time that a black frame is displayed between image frames. One embodiment includes display region, a data driver, a scan driver, and a controller. The display region displays frames of images according to a data signal and a scan signal. The data driver transmits data for displaying first frames and second (black) frames between the first frames. The scan driver includes first and second scan driving circuits for transmitting scan signals, and a switch unit for selectively coupling the first and second scan driving circuits. The scan driver transmits scan signals sequentially during the first frames and transmits scan signals to at least two of the scan lines concurrently by driving the first and second scan driving circuits in parallel during the second frames. The controller transmits a driving control signal to control the switch.

3 Claims, 3 Drawing Sheets

(56) References Cited

U.S. PATENT DOCUMENTS

| | | | | |
|---|---|---|---|---|
| 2005/0237294 | A1 | 10/2005 | Miyachi | |
| 2006/0061540 | A1* | 3/2006 | Harada | 345/103 |
| 2007/0001960 | A1 | 1/2007 | Kim et al. | |
| 2007/0046601 | A1* | 3/2007 | Shin et al. | 345/89 |
| 2007/0132709 | A1 | 6/2007 | Kawaguchi | |
| 2007/0262974 | A1* | 11/2007 | Take | 345/204 |
| 2008/0002803 | A1* | 1/2008 | Kim et al. | 377/64 |
| 2008/0273023 | A1 | 11/2008 | Nose et al. | |
| 2009/0160845 | A1* | 6/2009 | Jang et al. | 345/214 |

FOREIGN PATENT DOCUMENTS

| | | | |
|---|---|---|---|
| JP | 59-018994 | | 1/1984 |
| JP | 5-224814 | | 9/1993 |
| JP | 2000-322032 | | 11/2000 |
| JP | 2000-322032 | A | 11/2000 |
| JP | 2002-091376 | | 3/2002 |
| JP | 2002-123208 | | 4/2002 |
| JP | 2002-358051 | | 12/2002 |
| JP | 2003-140619 | | 5/2003 |
| JP | 2003-140619 | A | 5/2003 |
| JP | 2005-106998 | | 4/2005 |
| JP | 2005-221695 | | 8/2005 |
| JP | 2005-221695 | A | 8/2005 |
| JP | 2007-148222 | | 6/2007 |
| KR | 100234938 | B1 | 9/1999 |
| KR | 10-2004-0004858 | | 1/2004 |
| KR | 10-0705617 | B1 | 4/2007 |
| KR | 10-2007-0068181 | | 6/2007 |
| KR | 1020070025765 | A | 8/2007 |
| KR | 1020080092477 | A | 10/2008 |
| WO | WO 2004/006008 | A1 | 1/2004 |

OTHER PUBLICATIONS

KIPO Office action dated Oct. 20, 2010, for priority Korean Patent application 10-2009-0006907.

European Search Report dated Jan. 27, 2010, for corresponding European patent application 09176716.0.

KR Office Action dated Jun. 16, 2011 issued in Korean Application No. 10-2009-0006907, 2 pages.

Office Action; Chinese Patent Application No. 200910221720.X, dated Feb. 6, 2012, 5 pages.

Japanese Office action dated Dec. 13, 2011, for corresponding Japanese Patent application 2009-094024, 2 pages.

China Office action for Chinese Patent Application No. 200910221720, dated Aug. 16, 2012, 8 pages.

Patent Gazette for European Patent No. 2214153, dated Jan. 8, 2014, 4 pages.

SIPO Office action dated Feb. 17, 2013, for corresponding Chinese Patent application 200910221720.X, (7 pages).

Japanese Office action dated Dec. 18, 2012, for corresponding Japanese Patent application 2009-094024, (2 pages).

English machine translation of Exemplary Claim for Japanese Publication 59-018994, (1 page), Jan. 31, 1984.

* cited by examiner

ORGANIC LIGHT EMITTING DISPLAY DEVICE INCLUDING A PLURALITY OF SCAN DRIVING CIRCUITS FOR DRIVING SCAN SIGNALS CORRESPONDING TO IMAGE SIGNALS AND BLACK IMAGE SIGNALS AND METHOD OF DRIVING THE SAME

CROSS-REFERENCE TO RELATED APPLICATIONS

This application claims priority to and the benefit of Korean Patent Application No. 10-2009-0006907, filed on Jan. 29, 2009, in the Korean Intellectual Property Office, the entire content of which is incorporated herein by reference.

BACKGROUND OF THE INVENTION

1. Field of the Invention

The present invention relates to an organic light emitting display device and a method of driving the same.

2. Description of Related Art

Recently, various flat panel display devices having reduced weight and volume over cathode ray tubes have been developed. Among flat panel display devices, there are liquid crystal display (LCD) devices, field emission display (FED) devices, plasma display panels (PDPs), organic light emitting display (OLED) devices, etc.

Among other displays, organic light emitting display devices have various advantages including excellent color reproducibility, slimness, and the like, and have application in wide fields such as personal digital assistants (PDAs) and MP3 players, as well as cellular phones.

The organic light emitting display devices display images using organic light emitting diodes (OLED) that determine a brightness of light corresponding to an amount of current to be input.

The flat panel display devices as described above have a problem in that motion blur may occur. Korean Patent Publication No. 2007-0068181 discloses an entire screen being displayed in black between frames in order to address the motion blur.

Based on the above reason, in order to prevent the motion blur, the organic light emitting display device allows the entire screen to be displayed in black by blocking the driving current flowing into the organic light emitting diode.

However, recently display devices started changing frames at 30 frames per second (fps) at a high resolution. Therefore, more scan signals are sequentially generated in a high resolution screen than in a low resolution screen during a short time during which one frame is maintained, so that a time when a data signal is transmitted to a pixel to be maintained is very short. The aspect of a very short time when a data signal is transmitted to a pixel to be maintained means that a time when the black image inserted for blocking the motion blur is maintained is correspondingly also short.

At this time, if the time that the black image is displayed is very short, the time that the current is blocked in the organic light emitting diode is short, causing a problem that the motion blur is not effectively prevented.

SUMMARY OF THE INVENTION

Therefore, it is an aspect of an exemplary embodiment of the present invention to provide an organic light emitting display device that shortens a time when a black image is input for reducing or preventing a motion blur phenomenon, and a method of driving the same.

According to a first aspect of the present invention an organic light emitting display device includes a display region, a data driver, a scan driver, and a controller. The display region displays frames of images according to data signals and scan signals. The data driver transmits data for displaying first frames of the frames and transmits data for displaying second frames of the frames, each of the second frames for displaying black on an entirety of the display region between the first frames. The scan driver includes first and second scan driving circuits for transmitting the scan signals on a plurality of scan lines, and a switch unit for selectively coupling the first and second scan driving circuits. The scan driver is configured to transmit the scan signals to the scan lines sequentially during the first frames and to transmit respective scan signals to at least two of the scan lines concurrently by driving the first and second scan driving circuits in parallel during the second frames. The controller outputs a driving control signal to control the switch unit.

The first scan driving circuit may include a first input terminal that receives a start pulse and a plurality of first output terminals that sequentially output a plurality of scan signals responsive to the start pulse.

The second scan driving circuit may include a second input terminal that receives the start pulse or the scan signal transmitted from the last output terminal of the first output terminals, and a plurality of second output terminals that output a plurality of scan signals corresponding to the start pulse or the scan signal output from the last output terminal.

The switch unit may include a first transistor for selectively coupling the last output terminal of the first output terminals of the first scan driving circuit to the second input terminal of the second scan driving circuit responsive to the control signal; and a second transistor for selectively transmitting the start pulse to the second input terminal of the second scan driving circuit responsive to the control signal.

The first transistor and the second transistor may have different channel types. For example, the first transistor may be a p-channel transistor and the second transistor may be an n-channel transistor.

According to a second aspect of the present invention, a method of driving an organic light emitting display device includes a data driver and a scan driver having a plurality of scan driving circuits. Data for displaying images in first frames is transmitted, the data including image data and in second frames including black data, the first frames alternating with the second frames. The plurality of scan driving circuits of the scan driver are operated in sequence during the first frames, and the plurality of scan driving circuits of the scan driver are operated in parallel during the second frames.

When operating the plurality of scan driving circuits of the scan driver in parallel, the scan driver may transmit a start pulse to the plurality of scan driving circuits in parallel responsive to a control signal, and may block a coupling between at least two of the plurality of scan driving circuits responsive to the control signal.

When operating the plurality of scan driving circuits of the scan driver in series, the scan driver may transmit the start pulse to one of the plurality of scan driving circuits responsive to the control signal, and may electrically couple together the at least two of the plurality of scan driving circuits.

The start pulse or a last scan signal of the first driving circuit may be selectively transmitted to a second scan driving circuit of the plurality of scan driving circuits.

With the organic light emitting display device and the method of driving the same according to exemplary embodiments of the present invention, the time during which the black image is maintained can be increased by reducing the time required to insert the black image, making it possible to reduce or prevent a motion blur phenomenon from occurring on the flat panel display device that displays a large and high precision image.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EMBODIMENTS

Figure 1:
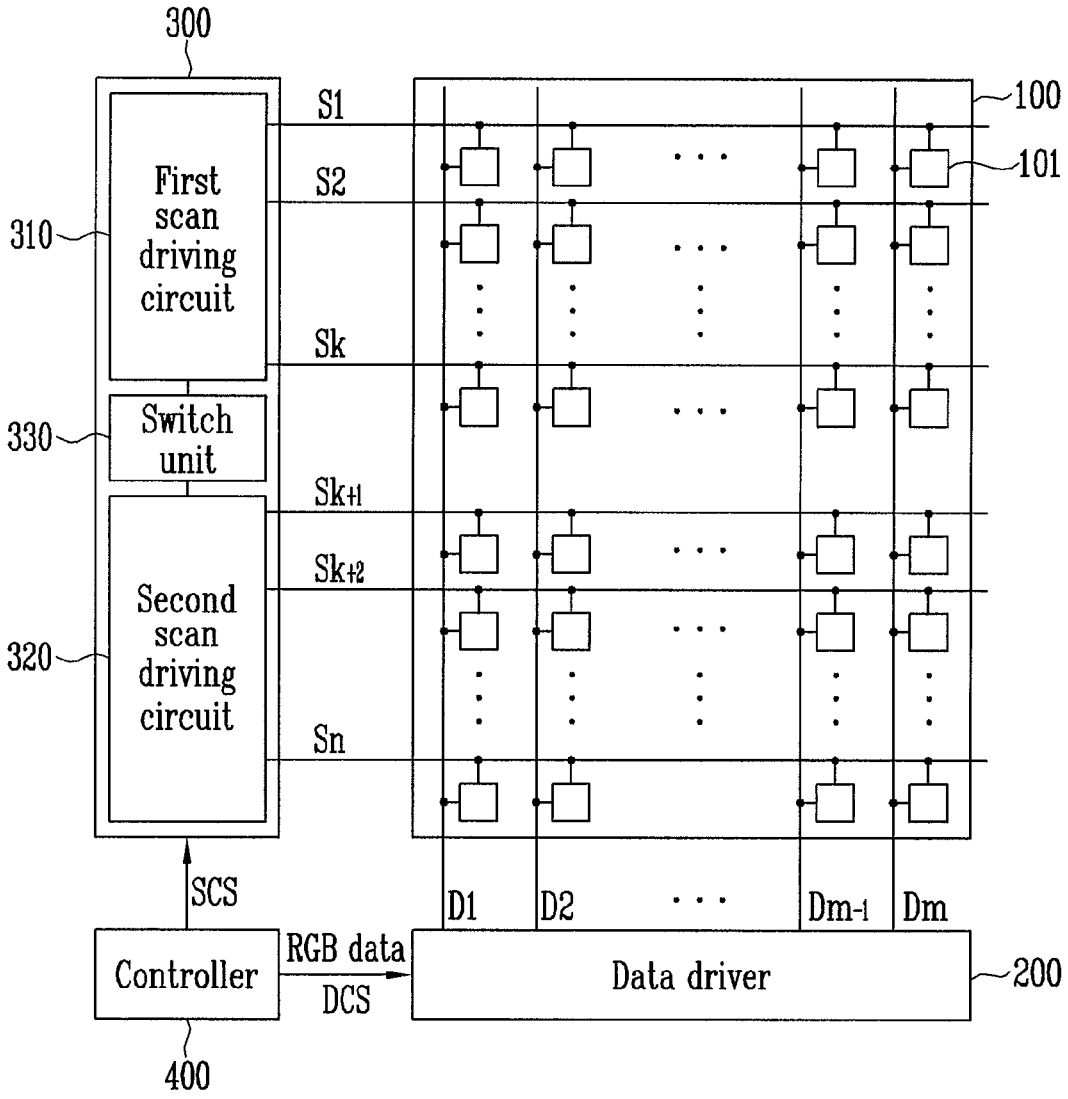
FIG. 1 is a structure view of an organic light emitting display device according to an exemplary embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

Hereinafter, exemplary embodiments of the present invention will be described with reference to the accompanying drawings.

FIG. 1 is a structure view of an organic light emitting display device according to an exemplary embodiment of the present invention. Referring to FIG. 1, the organic light emitting display device includes a display region 100, a data driver 200, a scan driver 300 and a controller 400.

The display region 100 includes a plurality of pixels 101, wherein each of the pixels 101 includes an organic light emitting diode (OLED, not shown) that emits light corresponding to a current flow through the OLED. On the display region 100, n scan lines S1, S2, . . . Sn−1, and Sn extend in a row direction for transmitting scan signals, and m data lines D1, D2, . . . Dm−1, and Dm extend in a column direction for transmitting data signals.

Also, the display region 100 is driven by receiving first power ELVDD and second power ELVSS. Therefore, the display region 100 emits light to display images by allowing current to flow on the organic light emitting diode in accordance with the scan signals, the data signals, the first power ELVDD, and the second power ELVSS.

The data driver 200 generates data signals corresponding to image signals (RGB data) input through the controller 400 and further, corresponding to black image signals. At this time, one frame is generated utilizing the data signals, wherein first frames are implemented through the data signals utilizing the image signals RGB data having red, green and blue components and second frames are implemented through the data signals utilizing the black image signals. The data driver 200 transmits the data signals to the display region 100 to enable the image formed in a plurality of frames including the first frames and the second frames to be displayed on the display region 100. At this time, the images displayed on the display region 100 includes the second frames periodically inserted between the plurality of first frames, thereby enabling some frames of the images to be displayed in black. The motion blur is reduced by the second frames as described above.

The scan driver 300, which is a device that generates scan signals, is coupled to scan lines S1, S2, . . . Sn−1, and Sn to transmit scan signals to a specific row of the pixels 101. The data signals output from the data driver 200 are transmitted to the pixels 101 concurrently with the transmittal of the scan signals so that a voltage corresponding to the data signals is transmitted to the pixel 101. Also, the scan driver 300 includes a plurality of scan driving circuits 310 and 320 for generating scan signals. According to exemplary embodiments of the invention the plurality of scan driving circuits 310 and 320 are driven by two methods.

The first method relates to the driving of the scan driver 300 when the first frames are driven. After receiving a start pulse, the first scan driving circuit 310 generates scan signals in series to allow a last scan signal to function as the start pulse of the second scan driving circuit 320.

The second method relates to the driving of the scan driver 300 when the second frames are driven. The scan driving circuits 310 and 320 included in the scan driver 300 operate by concurrently receiving respective start pulses. If the scan driving circuits 310 and 320 included in the scan driver 300 concurrently receive the respective start pulses, the scan driving circuits 310 and 320 output scan signals in parallel. Therefore, data signals are transmitted concurrently to two rows of the pixels 101 so that a time required to form the second frames the data signals becomes short. As a result, the time that the second frames maintain the black image becomes long.

While the first frames are driven in accordance with the data signals output from the data driver 200, the switch unit 330 transmits the start pulse only to the first scan driving circuit 310 of the scan driver 300 and allows the respective scan driving circuits 310 and 320 to be electrically coupled to each other. The electrical coupling between the scan driving circuits 310 and 320 will be described in more detail below. While the second frames are driven in accordance with the data signals output from the data driver 200, the switch unit 330 transmits the start pulses to each of the plurality of scan driving circuits 310 and 320 and blocks the coupling between the plurality of scan driving circuits 310 and 320.

The controller 400 outputs data driving control signals DCS, scan driving control signals SCS and the data signals RGB data. Further, the controller 400 controls the operation of the switch unit 330 and allows the driving method of the scan signals output from the scan driver 300 to be different when driving the first frame and driving the second frame.

Figure 2:
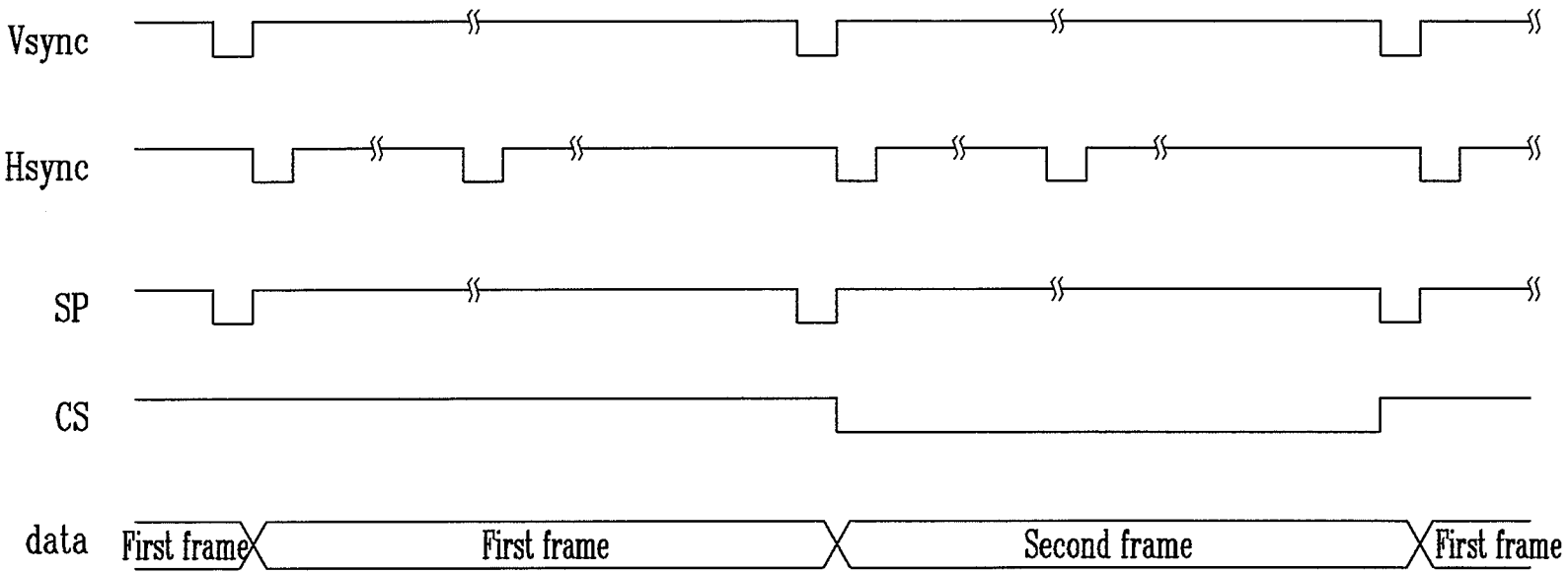
FIG. 2 is a timing diagram showing signals input to an organic light emitting display device according to an exemplary embodiment of the present invention.

FIG. 2 is a timing diagram showing signals transmitted to an organic light emitting display device according to an exemplary embodiment of the present invention. Referring to FIG. 2, in a displayed image, a data signal corresponding to one frame is transmitted at a time starting when a vertical synchronization signal Vsync is transmitted, and a data signal corresponding to a next frame is transmitted at a time starting when a next vertical synchronization signal Vsync is transmitted. A time when image signal RGB data corresponding to one horizontal line of the display region 100 is transmitted, and then a time when image signal RGB data corresponding to a next horizontal line thereof is transmitted is determined by a horizontal synchronization signal Hsync.

At this time, the vertical synchronization signal Vsync and the horizontal synchronization signal Hsync are transmitted during a period (e.g., a predetermined period) so that the time that one frame is driven is constant.

A time when a first scan signal is output from the scan driver 300 is determined by a start pulse SP corresponding to the vertical synchronization signal Vsync. In other words, when the start pulse SP is input to the scan driver 300, the scan driver 300 generates scan signals to be driven on the scan lines S1-Sn.

A driving control signal CS that controls the operation of the scan driver 300 is input corresponding to the first frames and the second frames. The driving control signal CS is included in the scan driving control signal SCS output from the controller 400. The operation of the scan driver 300 corresponding to each of the first frame and the second frame is determined by the driving control signal CS.

During the first frame, the scan signals are transmitted sequentially from the first scan line S1 to the last scan line Sn of the display region 100. Therefore, the data signals are applied to the pixels coupled to the scan lines S1-Sn according to the order that the scan signals are transmitted.

However, during the second frame, a plurality of the scan lines of the display region 100 are concurrently selected, so that the scan signals are concurrently transmitted from the plurality of scan lines. In other words, according to one embodiment a first scan signal Sk+1 is output from the second scan driving circuit 320 concurrently with a time when a first scan signal S1 is output from the first scan driving circuit 310. Therefore, the data signals are concurrently transmitted to the pixels coupled to the respective scan lines S1 and Sk+1.

Based on the reasons described above, during the second frame, in an embodiment having two scan driving circuits in the scan driver 300, the data signals are concurrently transmitted to two horizontal lines, and in an embodiment having four scan driving circuits, the data signals are concurrently transmitted to four horizontal lines. Therefore, the speed that the data signals are transmitted to the entirety of the display region 100 in the second frame is at least twice as fast as that in the first frame.

Because the vertical synchronization signal Vsync is input during a period of time (e.g., a predetermined period) as described above, if the time required to input the black image is fast as above, the time that the black image is maintained for each pixel becomes long. If the time that the black image is maintained in the pixel becomes long, the time that current does not flow on the organic light emitting diode becomes longer, making it possible to show the improvement resulting from the insertion of the frame constituted by the black image.

Figure 3:
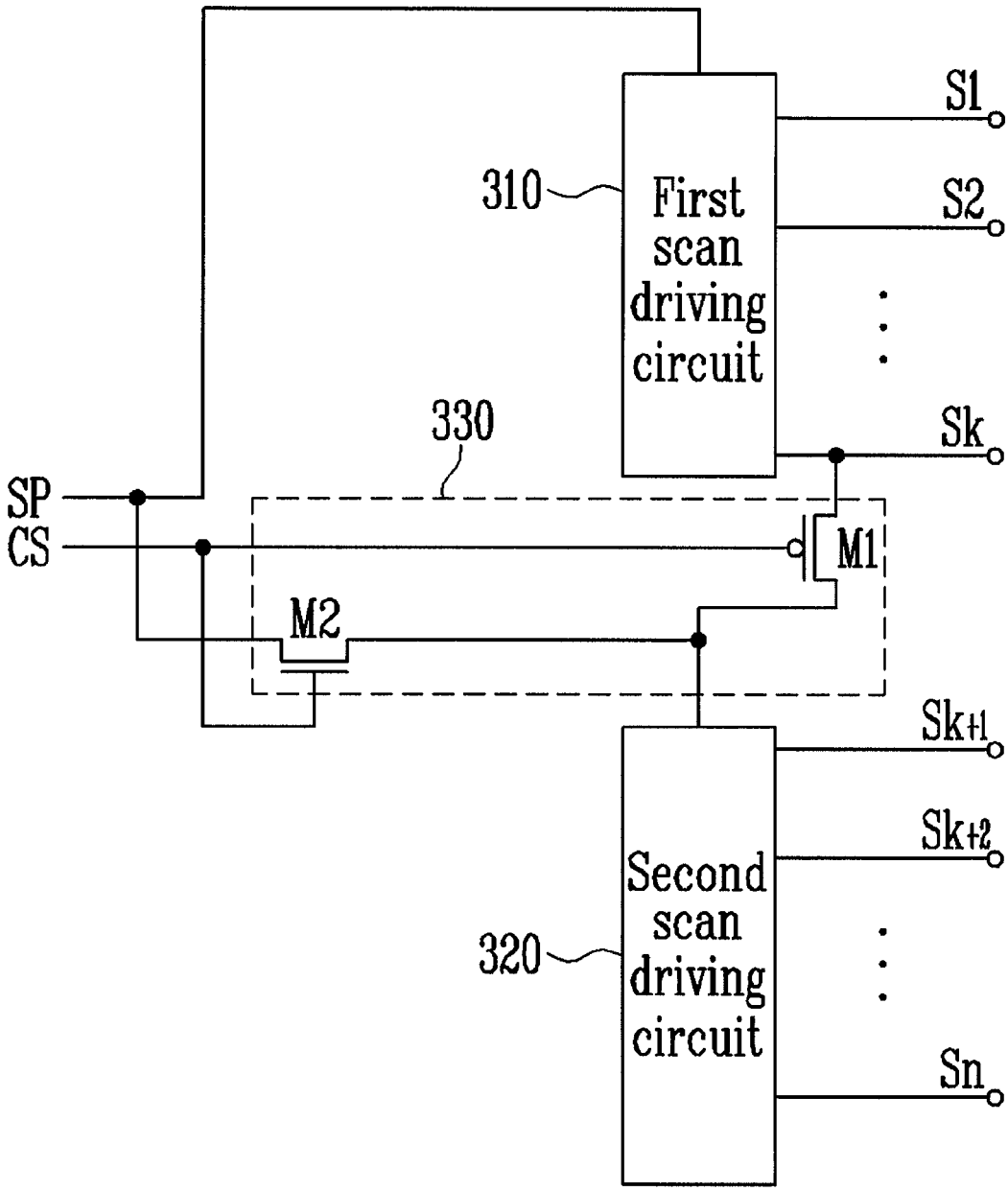
FIG. 3 is a structure view showing a coupling relationship between the scan driving circuit and the switch unit of FIG. 1.

FIG. 3 is a structure view showing a coupling relationship between the plurality of scan driving circuits 310 and 320 and the switch unit 330 of FIG. 1. Referring to FIG. 3, the scan driver 300 includes a first scan driving circuit 310, a second scan driving circuit 320, and a switch unit 330 that includes first and second transistors M1 and M2. The switch unit 330 is positioned between the first and second scan driving circuits 310 and 320.

The first scan driving circuit 310 generates a plurality of scan signals corresponding to a timing of a start pulse SP.

The second scan driving circuit 320 receives the start pulse SP or a scan signal of the scan signals generated by the first scan driving circuit 310 to start to be driven.

In the illustrated embodiment, the first transistor M1 is a p-channel device. The source of the first transistor M1 of the switch unit 330 is coupled to the last output terminal Sk of the first scan driving circuit 310, and the drain thereof is coupled to an input terminal of the second scan driving circuit 320. The gate of the first transistor M1 is coupled to a control terminal to which the scan control signal CS is input.

In the illustrated embodiment, the second transistor M2 is an n-channel device. The source of the second transistor M2 of the switch unit 330 is coupled to a terminal to which the start pulse SP is input and the drain thereof is coupled the input terminal of the scan driving circuit 320. The gate of the second transistor M2 is coupled to the control terminal to which the scan control signal CS is input.

The scan driver 300 constituted as above is driven in a different way when driving the first frame from when driving the second frame.

First, when driving the first frame, as illustrated in FIG. 2, the control signal CS is high. Thus, the first transistor M1 is in a turned-on state, and the second transistor M2 is in a turned-off state. At this time, the first scan driving circuit 310 receives the start pulse SP, and generates the plurality of scan signals in series. Because the first transistor M1 is in the turned-on state, the last scan signal of the scan signals generated from the first scan driving circuit 310 conducts through the first transistor M1 and is transmitted to the second scan driving circuit 320. Because the second transistor M2 is in the turned-off state, the start pulse SP input to the first scan driving circuit 310 is blocked from being input to the second scan driving circuit 320. Thus, the last scan signal generated by the first scan driving circuit 310 functions as the start pulse of the second scan driving circuit 320.

When driving the second frame, as illustrated in FIG. 2 the control signal CS is low, and thus the first transistor M1 of the switch unit 330 is in the turn-off state and the second transistor M2 is in the turn-on state. Therefore, the start pulse SP is transmitted through the second transistor M2, and is thus concurrently transmitted to the first scan driving circuit 310 and the second scan driving circuit 320. However, because the first transistor M1 is in the turned-off state, the coupling between the first scan driving circuit 310 and the second scan driving circuit 320 is blocked. Therefore, the first scan driving circuit 310 and the second scan driving circuit 320 are driven in parallel to output the plurality of scan signals, respectively.

While the present invention has been described in connection with certain exemplary embodiments, it is to be understood that the invention is not limited to the disclosed embodiment, but, on the contrary, is intended to cover various modifications and equivalent arrangements included within the spirit and scope of the appended claims, and equivalents thereof.

What is claimed is:

1. An organic light emitting display comprising:

a display region for displaying frames of images according to data signals and scan signals;

a data driver for transmitting data for displaying first frames of the frames, and for transmitting data for displaying second frames of the frames, each of the second frames for displaying black on an entirety of the display region between the first frames;

a scan driver comprising:

first and second scan driving circuits for transmitting the scan signals on a plurality of scan lines; and a switch unit for selectively coupling the first and second scan driving circuits; and a controller for transmitting a control signal to control the switch unit, wherein the scan driver is configured to transmit the scan signals to the scan lines sequentially during the first frames, and to transmit respective scan signals to at least two of the scan lines concurrently by driving the first and second scan driving circuits in parallel during the second frames, wherein the first scan driving circuit comprises a first input terminal for receiving a start pulse and a plurality of first output terminals for sequentially outputting a plurality of scan signals responsive to the start pulse, wherein the second scan driving circuit comprises:

a second input terminal for receiving the start pulse or one of the scan signals transmitted from a last output terminal of the first output terminals; and a plurality of second output terminals for outputting a plurality of scan signals corresponding to the start pulse or the one of the scan signals transmitted from the last output terminal, and wherein the switch unit comprises:

a first transistor for selectively coupling the last output terminal of the first output terminals of the first scan driving circuit to the second input terminal of the second scan driving circuit responsive to the control signal; and a second transistor for selectively transmitting the start pulse to the second input terminal of the second scan driving circuit responsive to the control signal.

2. The organic light emitting display as claimed in claim 1, wherein the first transistor and the second transistor have different channel types.

3. The organic light emitting display as claimed in claim 2, wherein the first transistor is a p-channel transistor and the second transistor is an n-channel transistor.

* * * * *